US005381931A

United States Patent [19]

Chang

[11] Patent Number: 5,381,931

[45] Date of Patent: Jan. 17, 1995

[54] CAULK DISPENSING DEVICE WITH MULTI-POSITION THRUST SELECTION DIAL

[76] Inventor: Peter J. Y. Chang, 11001 Petersborough Dr., Rockville, Md. 20852

[21] Appl. No.: 205,655

[22] Filed: Mar. 4, 1994

[51] Int. Cl.[6] ..... B65D 88/54

[52] U.S. Cl. ..... 222/309; 222/391; 74/525

[58] Field of Search ..... 222/309, 326, 327, 391; 74/523, 525, 141.5

[56] References Cited

U.S. PATENT DOCUMENTS

| | | | |
|---|---|---|---|
| 4,390,115 | 6/1983 | Bigham | 222/326 |
| 4,461,407 | 7/1984 | Finnegan | 222/391 |
| 4,471,888 | 9/1984 | Herb et al. | 222/137 |
| 4,566,610 | 6/1986 | Herb | 222/137 |
| 4,664,298 | 5/1987 | Shew | 222/287 |
| 4,681,524 | 7/1987 | Ikeda et al. | 425/376 R |
| 4,802,607 | 2/1989 | Johnson | 222/82 |
| 4,826,050 | 5/1989 | Murphy et al. | 222/175 |
| 4,907,727 | 3/1990 | Ernst et al. | 222/386 |
| 5,020,693 | 6/1991 | Ernst et al. | 222/137 |
| 5,052,243 | 10/1991 | Tepic | 74/523 |
| 5,156,305 | 10/1992 | Eyre | 222/327 |
| 5,181,636 | 1/1993 | Anderson et al. | 222/389 |
| 5,192,008 | 3/1993 | Hwan | 222/391 |
| 5,197,635 | 3/1993 | Chang | 222/391 X |
| 5,248,068 | 9/1993 | Goergen et al. | 222/326 |
| 5,263,614 | 11/1993 | Jacobsen et al. | 222/137 |

*Primary Examiner*—Gregory L. Huson

[57] ABSTRACT

A caulking gun incorporating an inexpensive and convenient adjustment feature which allows the user of a caulk dispensing gun to vary the thrust output while using the gun, The adjustment feature is accomplished by means of a selection dial pivotally mounted for orthogonal rotation about an upward tip of the trigger. The selection dial can be rotated into various positions for varying the thrust output of the caulking gun.

6 Claims, 4 Drawing Sheets

CAULK DISPENSING DEVICE WITH MULTI-POSITION THRUST SELECTION DIAL

CROSS-REFERENCE TO RELATED APPLICATIONS

The present application is related to Peter V. Chang U.S. Pat. No. 5,197,635 entitled "Variable Thrust Caulk Dispensing Device".

FIELD OF THE INVENTION

The present invention relates to dispensing devices and, more particularly, to a hand-held manual dispensing device with multi-position selection dial to vary the thrust output.

BACKGROUND OF THE INVENTION

Caulking guns are used to dispense a great variety of fluid compounds including urethane, vinyl, polyester, epoxy and other plastics or resins. These different compositions have different densities. Regardless, an effective caulk gun must be capable of delivering the various compositions with uniformity. Moreover, to effect proper beading of the compounds, a caulk gun should allow a user to dispense the compounds over a range of volumetric flow rates.

Conventional economy brand caulk guns generally fail to achieve satisfactory results. These are the manual trigger-operated devices incorporating a unidirectional gripping assembly which urges a piston rod forward to eject the compound from a cartridge. Unfortunately, it is difficult to achieve the high degree of leverage often needed to dispense denser compounds. For those who can muster the necessary hand strength, the plunger drive assembly often breaks.

In order to achieve acceptable flow rates, caulking guns evolved toward complex gear-drives or pneumatic actuators. However, these are very expensive to manufacture and produce.

There remains a clear demand for an inexpensive hand-held caulking gun capable of delivering a dense composition at a high delivery volume and flow rate.

Prior art Chang U.S. Pat. No. 4,081,112 addresses the demand. The Chang caulking gun positions the trigger pivot and trigger drive grip engagement above the plunger shaft. This improvement increases the leverage obtainable by a hand operated trigger and allows delivery of the composition at a higher volume and flow rate than was previously possible in a hand-held caulking gun. Moreover, the improvement can be accomplished at no additional cost.

Related also to Chang U.S. Pat. No. 5,197,635 is a further improvement in the form of a slidable bearing assembly which allows the user to alter the leverage obtainable by squeezing the trigger. As shown in FIG. 1 of the '635 patent, the bearing assembly includes a positionable bearing bit 100 which can be fixed by means of set screw 110 anywhere along the length of the upper trigger portion 30. The lower the position, the more the leverage, and the smaller the incremental movement of the plunger shaft 55. This arrangement succeeds in uniformly dispensing different compositions of different densities over a range of volumetric flow rates. Unfortunately, adjustments cannot be made on the fly. Instead, the user must cease caulking and procure a screwdriver in order to effect the adjustment. Moreover, the adjustable bearing assembly is relatively difficult and costly to manufacture insofar as it requires machining of screw threads and the like.

Consequently, there remains a demand for a refined and less expensive adjustment feature which allows the user of a caulk dispensing gun to vary the thrust output while using the gun.

SUMMARY OF THE INVENTION

The present invention is a caulking gun that incorporates an inexpensive and convenient adjustment feature which allows the user of a caulk dispensing gun to vary the thrust output while using the gun. Generally, the gun includes a frame for carrying a caulking composition, a plunger shaft having a piston at one end for urging the caulking composition out of the frame, and a plunger driving assembly for driving the plunger shaft to expel the caulk. The plunger driving assembly is contained in a housing having a downwardly extending handle, and the assembly includes a trigger extending upwardly within the housing. The trigger is pivoted to the housing above said plunger shaft for hand contracting against the handle. The plunger driving assembly further includes a first gripping member enclosed within said housing, encircling the plunger shaft, and protruding upwardly beyond the plunger shaft within the housing. A first compression spring oppositely biases the first gripping member toward the trigger. The adjustment feature of the present invention is incorporated into the plunger driving assembly by means of an eccentric selection dial pivotally mounted for orthogonal rotation about an upward tip of the trigger. The selection dial can be rotated into various positions for varying the thrust output of the caulking gun. For instance, in the "on/off" configuration to be described, the selection dial is selectively rotatable into a first position for engagement with the upward protrusion of the first gripping member when said trigger is contracted, and into a second non-engaging position when the trigger is contracted. Consequently, the first gripping member may be driven by the selection dial when in the first position to increase the incremental displacement of the plunger shaft when the trigger is contracted.

The adjustment feature is simple and highly effective, and it can be manufactured for a fraction of the cost of existing adjustable-thrust caulking guns. Moreover, a user can vary the thrust "on the fly" while applying caulk, and without the use of special tools.

DETAILED DESCRIPTION OF THE PREFERRED EMBODIMENT

Figure 1:
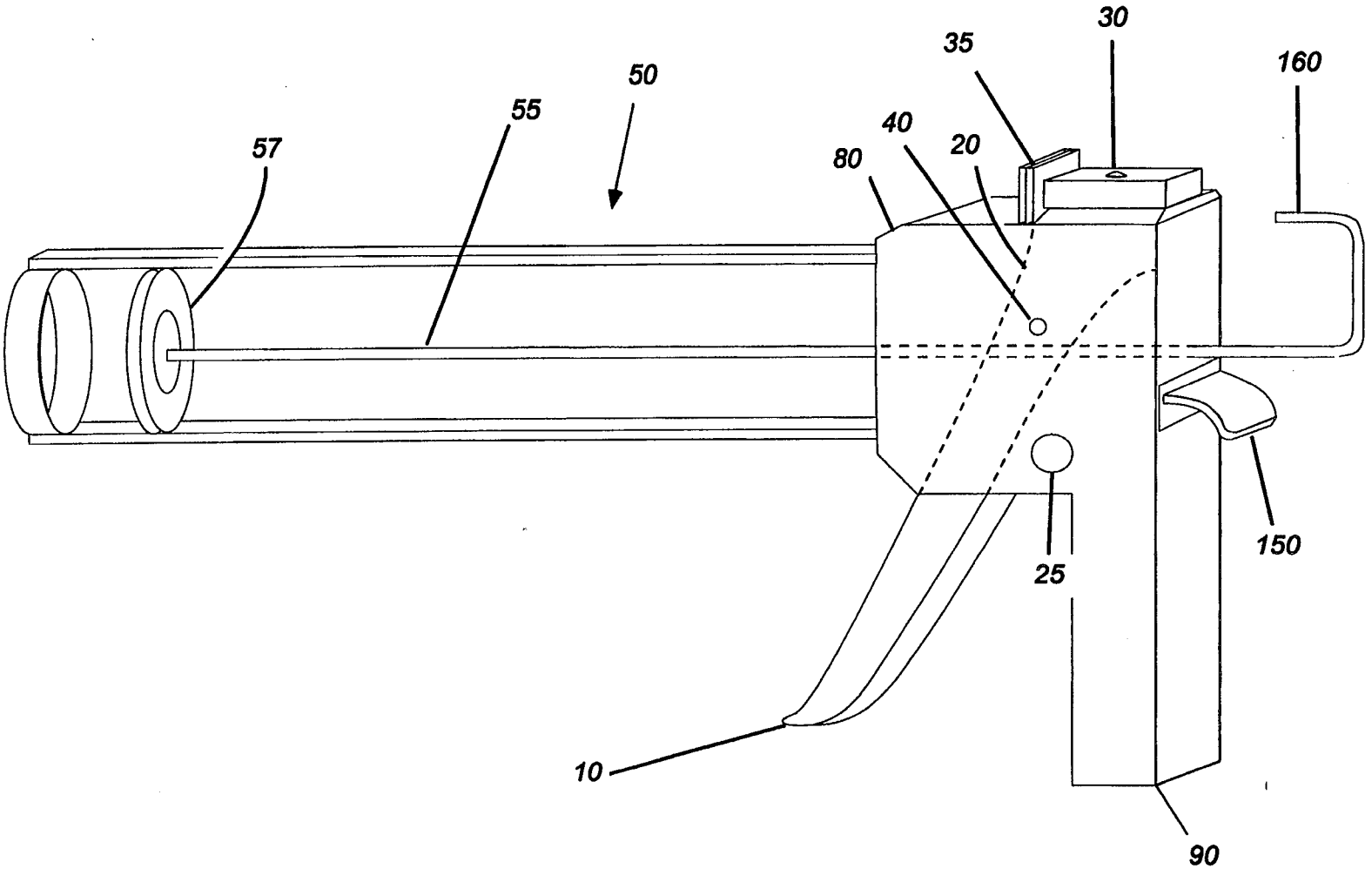
FIG. 1 is a perspective view of a manually operated caulk dispensing device incorporating a multi-position thrust selection dial according to the present invention.

FIG. 1 is a perspective view of a manually operated caulk dispensing device incorporating a multi-position thrust selection dial according to the present invention.

The caulking gun includes a frame 50 for slidably guiding a piston 57 fixed at the end of a plunger shaft 55. The illustrated frame 50 is adapted for carrying a conventional caulk cartridge. However, frame 50 may alternatively be a tubular barrel frame for containing loose composition. The plunger shaft 55 is driven by a plunger drive assembly including a housing 80, and a trigger 10 preferably pivoted at a screw hinge 40 located above plunger shaft 55.

In accordance with the present invention, the plunger drive assembly also includes a multi-position selection dial 30 located on an upper portion 20 of trigger 10 which extends above screw hinge 40. In the illustrated position, the multi-position selection dial 30 bears against a grip 35 which engages plunger drive shaft 55. As trigger 10 is depressed, the multi-position selection dial 30 is urged forwardly against the grip 35, and grip 35 in turn forwardly biases plunger shaft 55. Further contraction of trigger 10 is converted into lateral movement of plunger drive shaft 55.

Figure 2:
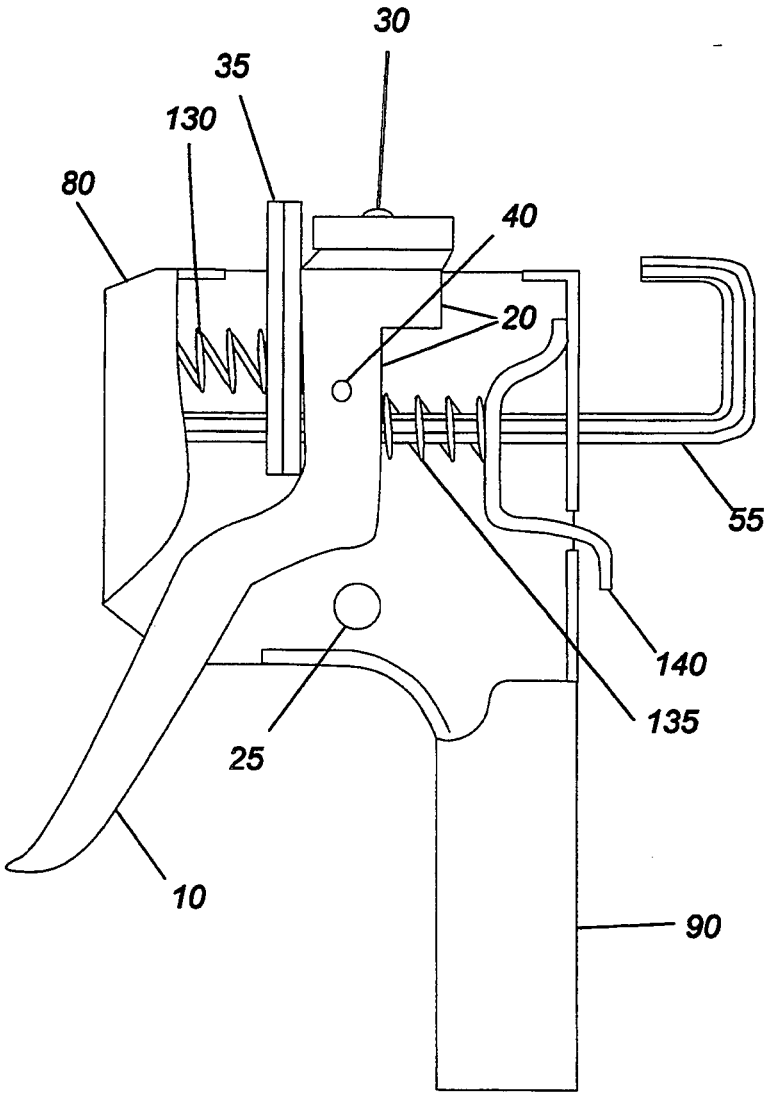
FIG. 2 is a break-away side view of the plunger drive assembly of FIG. 1.

FIG. 2 shows a break-away side view of the plunger drive assembly of FIG. 1. Plunger drive shaft 55 extends through, and is slidably carried within housing 80. Trigger 10 extends upwardly into housing 80, straddles plunger shaft 55, and is pivotally fixed to housing 80 at a screw hinge 40 located above plunger shaft 55. An upper portion 20 of trigger 10 extends past screw hinge 40. The multi-position selection dial 30 is pivotally mounted on the upper tip of trigger 10. A first gripping member 35 is carried by plunger shaft 55 and is biased away from the left wall of housing 80 toward trigger 10 by a first compression spring 130. An opposite resilient bias is imparted against trigger 10 by compression spring 135. The opposite end of compression spring 135 is buttressed against a second gripping member 140 which extends downwardly from the top of housing 80 and straddles plunger shaft 55. The second gripping member 140 curves inwardly from the rear wall of housing 80 to provide a footing thereagainst, and then parallels the rear wall of housing 80 along its midsection. The opposite end of compression spring 135 bears against the midsection of second gripping member 140. The lower length of second gripping member 140 (beneath the plunger shaft 55) is curved toward the fight wall of housing 80 and exits the housing 80 through a slotted aperture. The outwardly protruding tip of second gripping member 140 is bent downwardly to provide a convenient thumb-release.

In operation, contraction of trigger 10 is pivots the upper section 20 about screw hinge 40. In the engaged position (shown), selection dial 30 bears against first gripping member 35 as trigger 10 is contracted. As first gripping member 35 is pressed forward, it engages plunger shaft 55 and causes plunger shaft 55 to be driven forward through housing 80. As trigger 10 is released, it is biased back to its original position by compression spring 130. Although trigger 10 retracts, second gripping member 140 engages plunger drive shaft 55 to prevent the shaft from back-sliding. The above-described operation is repeated to drive the plunger shaft 55 incrementally forward until the caulk cylinder is depleted and/or the operator desires to stop. At this point the portion of second gripping member 140 extending downwardly outside of housing 80 can be depressed, thereby releasing the second gripping member 140 from plunger shaft 55 and relieving all pressure. An operator may grasp the angled rearward end of plunger shaft 55 for convenient extraction of piston 57 from a caulk cylinder (not shown). The caulk cylinder can then be easily removed and discarded.

Figure 3:
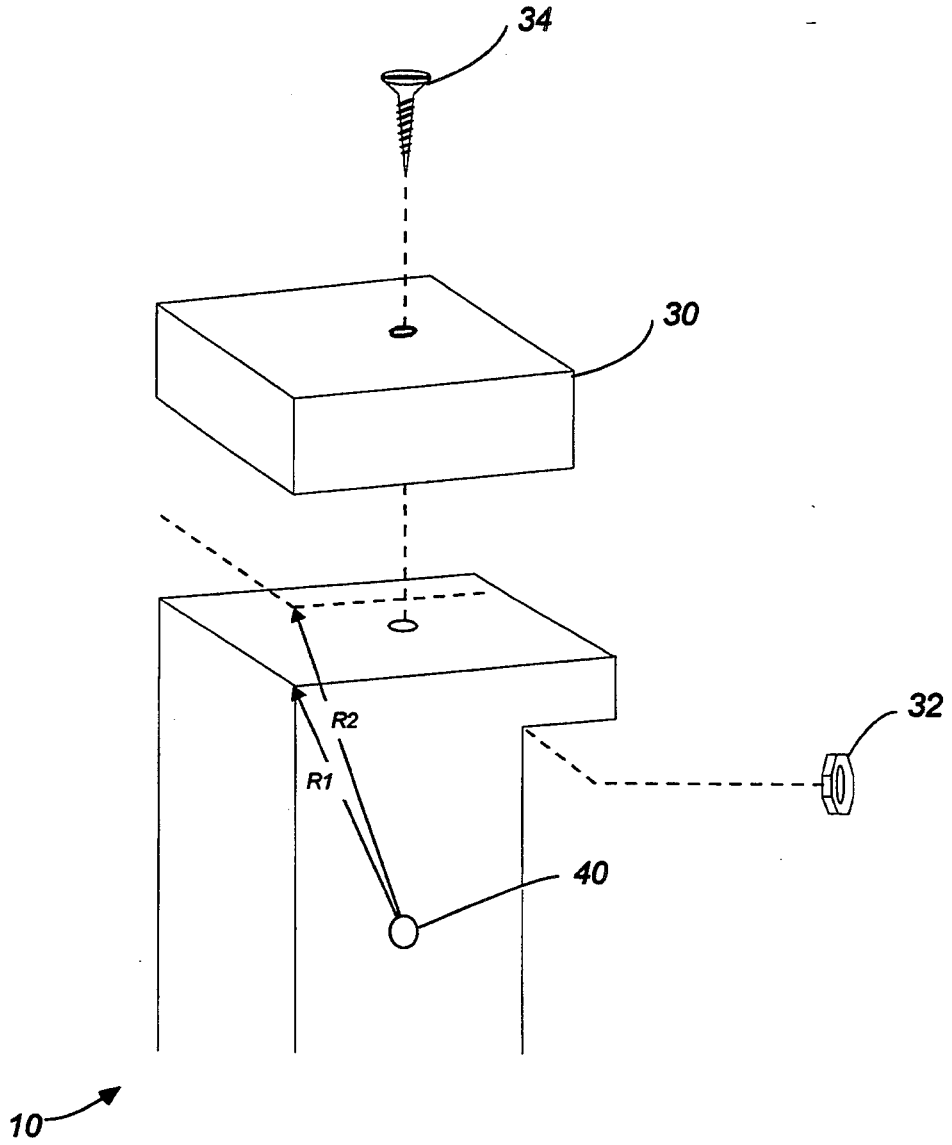
FIG. 3 is a detailed exploded diagram of the multi-position selection dial 30 of FIGS. 1 and 2.

FIG. 3 is a detailed exploded diagram of the multi-position selection dial 30 illustrating its pivotal mounting to the upper tip of trigger 10. In the illustrated embodiment, a rectangular selection dial 30 is employed, and this is pivoted at one end away from its bearing engagement with first gripping member 35. When pivoted 90° in either direction from the initial position of FIG. 2, the selection dial 30 will no longer engage the first gripping member 35. Instead, the upper portion 20 of trigger 10 will engage first gripping member 35. The selection dial 30 effectively extends the length of the upper portion 20 of trigger 30. For example, in a standard size caulk gun it is contemplated that the radius $r_1$ to the point of engagement with trigger 10 will be approximately 0.25 to 0.33 inches shorter than the radius $r_2$ to the point of engagement with selection dial 30. Consequently, in shifting the selection dial 30 back into engagement, a 25–33% decrease in thrusting power occurs (given a constant moment of torque about screw hinge 40), while a 25–33% increase in displacement of plunger shaft 55 will occur per contraction of trigger 10. Conversely, when the selection dial 30 is shifted out of engagement, a 25–33% increase in thrusting power occurs (again, the moment of torque about screw hinge 40 remains constant), while a 25–33% decrease in displacement of plunger shaft 55 will occur per contraction of trigger 10.

Of course, various differentials may be accomplished using different configurations of selection dial 30, and all arc considered within the scope of the present invention. For instance, a plurality of incremental thrust adjustments may be accomplished by use of a graded selection dial. It is only necessary to establish different radii to the point of engagement with trigger 10 or selection dial 30 by the positioning of dial 30.

Figure 4:
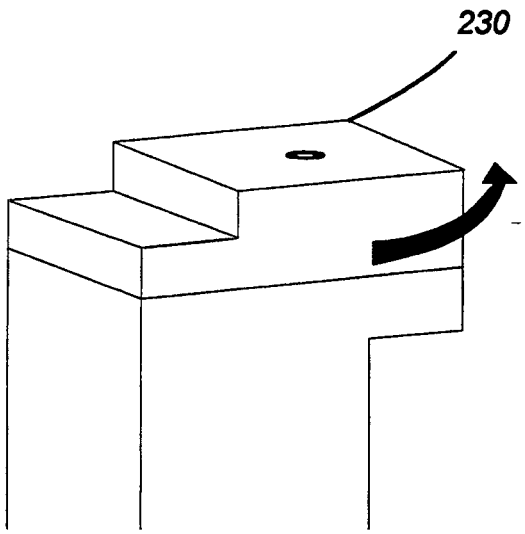
FIGS. 4 and 5 are two alternative configurations of the selection dial 30 of FIGS. 1–3.
Figure 5:
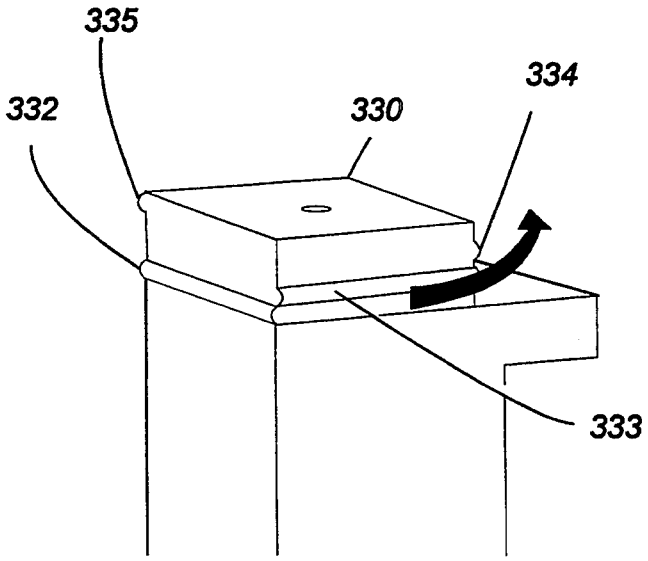

FIGS. 4 and 5 are two alternative configurations of the selection dial 30 of FIGS. 1–3.

The rectangular configuration of selection dial 230 in FIG. 4 is similar to that of FIGS. 1–3 except that the pivotal mounting to the upper tip of trigger 10 is centralized and both ends of selection dial 230 may be rotated to engage the first gripping member 35. However, the two ends of selection dial 230 are of different thicknesses. This yields two possible radii to the point of engagement with selection dial 230, plus a third radius to the point of engagement with trigger 10. As a result there are three possible thrust settings.

The square configuration of selection dial 330 with four staggered protrusions 332–335 in FIG. 5 results in four possible radii to the point of engagement with selection dial 330, and four possible thrust settings. The principle can be extended to various other shapes as well.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

I claim:

1. A caulking gun, comprising:

a frame for carrying a caulking composition;

a plunger shaft having a piston at one end for urging said caulking composition out of said frame;

a plunger driving assembly for driving said plunger shaft, said plunger driving assembly further comprising, a housing having a downwardly extending handle, a trigger extending upwardly within the housing, said trigger being pivoted to said housing above said plunger shaft for hand contracting against said handle, a first gripping member enclosed within said housing, said first gripping member encircling the plunger shaft and protruding upwardly beyond the plunger shaft within said housing, a first compression spring oppositely biasing said first gripping member toward said trigger;

a selection dial pivotally mounted for axial rotation about an upward tip of said trigger for varying a thrust output of said caulking gun, said selection dial being selectively rotatable into a first position for engagement with the upward protrusion of said first gripping member when said trigger is contracted, and into a second non-engaging position when said trigger is contracted;

whereby said first gripping member may be driven by said selection dial when in the first position to increase the incremental displacement of said plunger shaft when said trigger is contracted.

2. The caulking gun according to claim 1, wherein said selection dial is rectangular and rotatable about an eccentric pivot.

3. The caulking gun according to claim 1, wherein said handle has opposing sides and one of said sides is defined by a bore-hole for receiving a tip of a cartridge, whereby said tip is severed by said trigger when said trigger is pivoted.

4. The caulking gun according to claim 1, further comprising a plunger pressure retaining assembly including a second gripping member and second compression spring, the second gripping member being biased into a first position by the second compression spring and having a portion operable for releasing plunger pressure to allow manual retraction of said plunger.

5. The caulking gun according to claim 1, wherein said selection dial may be pivoted into said first position to cause said selection dial to engage said first gripping member when said trigger is contracted, and said selection dial may be pivoted into said second position to cause an upper portion of said trigger to engage said first gripping member when said trigger is contracted.

6. The caulking gun according to claim 5, wherein a radius $r_2$ is defined between said trigger pivot and a point of engagement of said selection dial with said first gripping member, and a radius $r_1$ is defined between said trigger pivot and a point of engagement of said trigger with said first gripping member, said radius $r_1$ being shorter than the radius $r_2$.

* * * * *